US008562502B2

(12) United States Patent
Murayama et al.

(10) Patent No.: US 8,562,502 B2
(45) Date of Patent: Oct. 22, 2013

(54) CENTRIFUGAL APPARATUS HAVING COOLING DEVICE

(75) Inventors: Ryou Murayama, Ibaraki (JP); Shoji Kusumoto, Ibaraki (JP); Yuki Shimizu, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 170 days.

(21) Appl. No.: 13/113,924

(22) Filed: May 23, 2011

(65) Prior Publication Data

US 2011/0294642 A1 Dec. 1, 2011

(30) Foreign Application Priority Data

May 26, 2010 (JP) ..... P2010-121053

(51) Int. Cl.
*B04B 7/02* (2006.01)
*B04B 15/02* (2006.01)

(52) U.S. Cl.
USPC ..... 494/14; 494/38; 494/60

(58) Field of Classification Search
USPC ..... 494/14, 16–21, 38, 39, 41, 60, 61
See application file for complete search history.

(56) References Cited

U.S. PATENT DOCUMENTS

| | | | | | |
|---|---|---|---|---|---|
| 3,779,048 | A * | 12/1973 | Kitamura et al. | ..... | 68/150 |
| 7,874,973 | B2 * | 1/2011 | Akatsu et al. | ..... | 494/14 |
| 7,901,342 | B2 * | 3/2011 | Tobita et al. | ..... | 494/14 |
| 7,909,751 | B2 * | 3/2011 | Tobita et al. | ..... | 494/37 |
| 2011/0294642 | A1 * | 12/2011 | Murayama et al. | ..... | 494/14 |

FOREIGN PATENT DOCUMENTS

| | | | |
|---|---|---|---|
| JP | 52-42445 U | | 9/1977 |
| JP | 2006-346617 | * | 12/2006 |
| JP | 2006-346617 A | | 12/2006 |
| JP | 2008104959 A | * | 5/2008 |
| JP | 2011245420 A | * | 12/2011 |
| JP | 2012-24728 | * | 2/2012 |
| JP | 2012110872 A | * | 6/2012 |

* cited by examiner

*Primary Examiner* — Charles E Cooley
(74) *Attorney, Agent, or Firm* — Kenealy Vaidya LLP

(57) ABSTRACT

A centrifugal separator includes: a rotor configured to hold a sample to be separated; a driving device configured to rotate the rotor and including a driving shaft; a chamber configured to contain the rotor and including a through hole through which the driving shaft is passed; a seal member configured to fitted over the through hole of the chamber and the driving shaft; a drain hole configured to discharge liquid in the chamber to an exterior; and an undulated part configured to guide a flow of the liquid and is provided on an upper surface of the seal member.

13 Claims, 8 Drawing Sheets

CENTRIFUGAL APPARATUS HAVING COOLING DEVICE

BACKGROUND

The present invention relates to a centrifugal separator having a cooling device, and more particularly, to the centrifugal separator capable of discharging dew condensation water which remain in a rotor room, at a time of cooling, to an exterior of the rotor room with high efficiency.

The centrifugal separator conducts separation or purification of a sample, by inserting the sample to be separated (incubating liquid, blood, for example) into a rotor by means of a tube or a bottle, and by rotating the rotor at a high speed. Set rotation speed of the rotor is different depending on objects for use. According to the objects for use, there are provided groups of products having the rotation speeds from a low speed (about several thousand rotations) to a high speed (the highest rotation speed is 150,000 rpm). Various types of rotors including, for example, an angle rotor having a tube hole of a fixed angle type and operable at the high rotation speed, a swing rotor in which a bucket loaded with a tube is swung from a vertical state to a horizontal state following rotation of the rotor, and so on are used. Moreover, there are rotors having various sizes including, for example, a rotor which is rotated at an ultrahigh rotation speed to apply high centrifugal acceleration to a small amount of sample, and a rotor which is rotated at a low rotation speed, but can deal with a large capacity of sample.

Some of the rotors should be kept at a low temperature depending on the sample. However, when the rotor holding the sample is rotated at a high speed in the atmosphere, the temperature tends to rise due to frictional heat occurring between an outer surface of the rotor and the air inside the rotor room. For this reason, a cooling device is mounted on many types of centrifugal separators so that the sample can be cooled and kept at a certain temperature. In the centrifugal separator having such a cooling device, in case where a door is opened after the centrifuging operation to expose the rotor room to an outside air, condensation occurs on a side wall of the rotor room, in some cases. As a countermeasure, as disclosed in Japanese Utility Model Publication No. JP-B-S52-42445U and Japanese Patent Publication No. JP-A-2006-346617, the centrifugal separator is so constructed that a drain hole is formed in a bottom part of a chamber which defines the rotor room, and dew condensation water which has been generated is discharged from the drain hole through a drain pipe to the exterior.

Herein, a structure of the related centrifugal separator will be described referring to FIG. 8. FIG. 8 is a vertical sectional view of a related centrifugal separator 101, in which a rotor room 105 is defined by a chamber 106, and a rotor 2 in the rotor room 105 is driven to rotate by a driving device 11. A refrigerating pipe 18 is wound around the chamber 106. An outlet side of the refrigerating pipe 18 is connected to a compressor 17 *a*, and an outlet side of the compressor 17 *a* is connected to a condenser 17 *b* via a pipe. An outlet side of the condenser 17 *b* is connected to the refrigerating pipe 18 via a throttle mechanism, which is not shown. The refrigerating pipe 18, compressor 17 *a*, condenser 17 *b*, throttle mechanism, and so on constitute a cooling device, which effectively cools the chamber 106 by passing a refrigerant through the refrigerating pipe 18. In this manner, by cooling the chamber 106 during the centrifuging operation, the temperature rise of the rotor 2 due to frictional heat which is generated between an outer surface of the rotor 2 and an air inside the rotor room 105 is depressed.

In order to keep the rotor 2 at a desired low temperature, for example, 4° C., the chamber 106 should be cooled to almost 0° C. However, when a door 7 is opened in a thus cooled state, immediately after the operation has stopped, an outside air intrudes into the rotor room 105, and water contained in the outside air is condensed on inner and outer surfaces of the chamber 106, to generate dew condensation water, in some cases. The dew condensation water which has been generated falls along a wall surface of the chamber 106 and remains in a bottom part of the chamber 106. When the dew condensation water remains inside the rotor room 105, an airflow which is generated inside the rotor room 105 is hindered by the dew condensation water, during rotation of the rotor 2, and resistance of the driving device 11 for driving the rotor 2 to rotate is inevitably increased. Moreover, there is such anxiety that the dew condensation water swirls together with the airflow which is generated in the rotor room 105 to enter into the sample, or to enter into a bucket 3.

Therefore, in the centrifugal separator which is disclosed in Japanese Patent Publication No. JP-A-2006-346617, a drain hole 113 is formed in the bottom part of the chamber 106, and the generated dew condensation water are allowed to flow from the drain hole 113 to a drain pipe 114 to be discharged to an exterior of the centrifugal separator 101 through a drain tube 115. The dew condensation water which remains in the rotor room 105 is affected by a flow of the air which is generated in the rotor room 105 during the rotation of the rotor 2, and spirally flows toward a center of a rotation shaft of the driving device 11, while winding around the rotation shaft of the driving device 11 in the bottom part of the chamber 106. A riser part 109 *a* in a cylindrical shape is provided in the bottom part of the chamber 106 so as to rise substantially vertically, and therefore, the dew condensation water is concentrated around the riser part 109 *a* to flow along an outer periphery of the riser part 109 *a* in the same direction as a rotation direction of the rotor 2 in such a manner as sticking to the riser part 109 *a*. The riser part 109 *a* is integrally formed with a seal rubber 109 which is fitted to an outer peripheral surface of the driving device 11. The drain pipe 114 is connected to the drain hole 113, and the flow of the dew condensation water which is generated with the rotation of the rotor 2 in the bottom part of the chamber 106 is guided to the drain pipe 114 to be discharged to the exterior of the centrifugal separator with high efficiency.

However, in the related structure, in case where speed of the airflow is high due to a high rotation of the rotor 2, or in case where an amount of the dew condensation water is large, it has sometimes occurred that while the dew condensation water flows around the riser part 109 *a*, a part of the dew condensation water overrides the riser part 109 *a* to arrive at a flat surface 109 *b* of the seal rubber 109 which covers an opening at an upper end of the riser part 109 *a*, and spirally flows along the flat surface 109 *b* toward the rotation center of the driving device. When the dew condensation water has arrived at the flat surface 109 *a* of the seal rubber 109 as described above, the dew condensation water is influenced by the airflow which is generated with the rotation of the rotor 2, and it becomes difficult to discharge the dew condensation water from the drain hole 113 which is opened at an outer peripheral side of the riser part 109 *a*, during the rotation of the rotor 2.

As a countermeasure, it is considered that a height of the riser part 109 *a* is made sufficiently high so that the dew condensation water may not override the riser part 109 *a*, even in a state where the speed of the airflow is high or the amount of the dew condensation water is large. However, in order to make the height of the riser part 109 *a* high, the chamber 106 should be made higher, and accordingly, a height of the centrifugal separator 101 itself becomes inevitably high, which badly affects usability of a user.

SUMMARY

The invention has been made in view of the above described background, and an object of the invention is to provide a centrifugal separator capable of effectively discharging dew condensation water which remains in a rotor room to an exterior of the rotor room with high efficiency.

Another object of the invention is to provide a centrifugal separator in which the dew condensation water existing on an upper surface of a seal rubber can be guided to a drain hole which is opened on an outer peripheral surface of a riser part, and can be effectively discharged to the exterior.

A still another object of the invention is to provide a centrifugal separator in which discharging efficiency of the dew condensation water can be enhanced, only by improving a shape of the seal rubber, and hence, an increase of the production cost is depressed.

Representative features of the invention which are disclosed in this application will be described as follows.

(1) A centrifugal separator comprising:
a rotor configured to hold a sample to be separated;
a driving device configured to rotate the rotor and including a driving shaft;
a chamber configured to contain the rotor and including a through hole through which the driving shaft is passed;
a seal member configured to fitted over the through hole of the chamber and the driving shaft;
a cooling device configured to cool the chamber;
a door configured to seal an opening of the chamber;
a drain hole configured to discharge liquid in the chamber to an exterior; and
an undulated part configured to guide a flow of the liquid and is provided on an upper surface of the seal member.

(2) The centrifugal separator according to (1), wherein
a riser part is disposed at the through hole of the chamber so as to be erected,
the seal member is fitted to the riser part,
the seal member includes a connection part to be connected to the driving device which is formed in a center part thereof, a fitting part to be fitted to the riser part at a circumferential side, and an annular region which is formed between the connection part and the fitting part, and
the undulated part is provided on an upper surface of the annular region.

(3) The centrifugal separator according to (2), wherein the drain hole is formed in the riser part.

(4) The centrifugal separator according to (1) to (3), wherein the undulated part is formed so as to extend from the radially innermost part of the annular region to the outer circumferential side of the annular region.

(5) The centrifugal separator according to (4), wherein the undulated part is continuously formed from the radially innermost part to the outer circumferential part.

(6) The centrifugal separator according to (5), wherein the undulated part is formed so as to be in rotation symmetry with respect to a rotation center of the seal member.

(7) The centrifugal separator according to (5), wherein the undulated part is spirally formed on an upper surface of the seal member.

(8) The centrifugal separator according to (6) or (7), wherein the undulated part is one of a projection and a stepped part for blocking the flow of the dew condensation water.

(9). The centrifugal separator according to (6) or (7), wherein the undulated part is a groove for guiding the dew condensation water.

(10) The centrifugal separator according to (1) to (9), wherein the seal member is formed of rubber, and a lower surface of the seal member is formed flat.

According to the aspect (1) of the disclosure, in the centrifugal separator having the drain hole for discharging the dew condensation water in the chamber, the undulated part for guiding the flow of the dew condensation water is provided on the upper surface of the seal member which is fitted over the through hole of the chamber and the driving shaft. As the results, it is possible to efficiently guide the dew condensation water which has overridden the riser part and the dew condensation water generated on the upper surface of the seal member, making use of airflows which spirally flow along the upper surface of the seal member toward the rotation center of the driving device.

According to the aspect (2) of the disclosure, the seal member has the annular region, and the undulated part is provided on the upper surface of the annular region. Therefore, the dew condensation water which spirally flows along the upper surface of the seal member toward the rotation center of the driving device can be guided to the outer circumferential edge of the seal member, and allowed to fall on the outer peripheral surface of the riser part. As the results, it is possible to prevent the dew condensation water from continuously swirling on the upper surface of the seal member, without being discharged from the drain hole.

According to the aspect (3) of the disclosure, the drain hole is formed in the riser part, and therefore, it is possible to effectively discharge the dew condensation water which has fallen on the outer peripheral surface of the riser part to the exterior of the centrifugal separator.

According to the aspect (4) of the disclosure, the undulated part is formed so as to extend from the radially innermost part to the outer circumferential side of the annular region. Therefore, the dew condensation water which spirally flows along the upper surface of the seal member is blocked by the projection at a small angle, and hardly overrides the projection. In this manner, the flow of the dew condensation water can be guided to a predetermined direction. Moreover, the dew condensation water is blocked by the airflow which is swirling in the rotor room, at a small angle. As the results, resistance which the airflow receives is reduced, and hence, an increase of the air loss can be depressed.

According to the aspect (5) of the disclosure, the undulated part is continuously formed from the radially innermost part to the radially outermost part of the annular region, and hence, it is possible to efficiently guide the dew condensation water to the drain hole which is positioned at the outer circumferential side.

According to the aspect (6) of the disclosure, the undulated part is formed in rotation symmetry with respect to the rotation center of the seal member. Therefore, it is possible to guide the dew condensation water which spirally flows along the upper surface of the annular region toward the rotation center of the driving device under the influence of the airflow which occurs with the rotation of the rotor, evenly to the outer circumferential side.

According to the aspect (7) of the disclosure, the undulated part is spirally provided on the upper surface of the seal member. Therefore, it is possible to effectively guide the dew condensation water which spirally flows along the upper surface of the annular region toward the rotation center of the driving device under the influence of the airflow which occurs with the rotation of the rotor, to the outer circumferential side.

According to the aspect (8) of the disclosure, because the undulated part is a projection or a stepped part for blocking the flow of the dew condensation water, it is possible to easily form the undulated part integrally with the seal member.

According to the aspect (9) of the disclosure, because the undulated part is a groove for guiding the dew condensation water, it is possible to realize the dew condensation water guiding means having least influence on the airflow which is swirling in the rotor room.

According to the aspect (10) of the disclosure, the seal member is formed of rubber, and hence, can be produced from low-cost material. Moreover, because the lower surface of the seal member is formed flat, it is possible to easily attach a heat insulating member or the like to the lower surface of the seal member.

The above described and other objects of the invention and novel features of the invention will be made apparent from the following description of the specification and the drawings.

DESCRIPTION OF EXEMPLARY EMBODIMENTS

Figure 1:
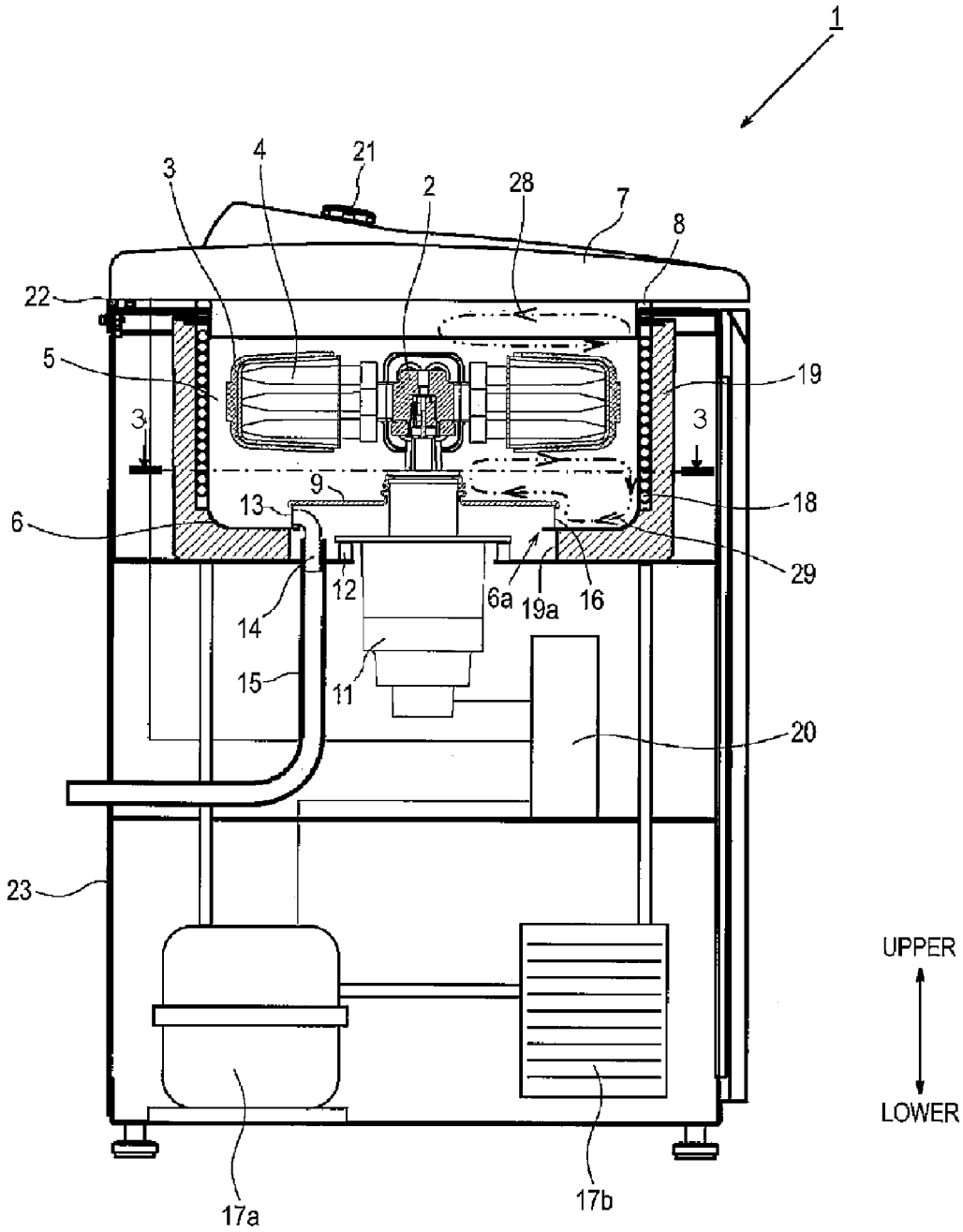
FIG. 1 is a vertical sectional view showing an entire structure of a centrifugal separator 1 in an embodiment according to the invention.

Now, exemplary embodiments will be described referring to the drawings. It is to be noted that in the attached drawings, same members will be denoted with same reference numerals, and repetitive descriptions will be omitted. Moreover, in the specification, a vertical direction is described as a direction as shown in FIG. 1.

First Embodiment

FIG. 1 is a vertical sectional view of a centrifugal separator 1 according to the exemplary embodiment. The centrifugal separator 1 includes a case body 23 which is formed of sheet metal or plastics in a box-like shape, and a chamber 6 for defining a rotor room 5 in the case body 23 which is closed with a door 7. The door 7 is tilted up and down around a hinge 22 thereby to open or close the chamber 6. A door packing 8 formed of elastic material such as rubber is fitted to a circumferential edge of an opening at an upper end of the chamber 6. Because of tight contact between the door 7 and the door packing 8, air tightness of the rotor room 5 is secured. A refrigerating pipe 18 is wound around the chamber 6, and connected to a compressor 17 *a* and a condenser 17 *b*. The chamber 6 is cooled, by passing a refrigerant through the refrigerating pipe 18. A heat insulating member 19 formed of foamed material or the like is provided outside the refrigerating pipe 18. During centrifuging operation, operation of the compressor 17 *a* is controlled by a control device 20, and an interior of the rotor room 5 is maintained at a desired temperature which has been set.

A round shape opening is formed through a bottom part of the chamber 6, and a driving device 11 is passed through the opening. A riser part 16 in a cylindrical shape which is substantially uprightly erected from the bottom surface of the chamber 6 is formed near the opening. The riser part 16 is a separate component formed of plastic, for example, which is produced separately from the chamber 6, and fixed to the chamber 6 by screwing or bonding. It is to be noted that the riser part 16 does not have to be a separate component, but may be integrally molded with the chamber 6 by stamping. A seal rubber 9 is fitted to a round circumferential edge of an upper part of the riser part 16, to cover an upper part of the driving device 11. The seal rubber 9 is formed of elastic material such as rubber. Because an opening at an upper end of the riser part 16 is covered with the seal rubber 9, high air tightness is secured inside the rotor 5. A through hole is formed near a center axis in an upper part of the seal rubber 9, and a rotation shaft extending upward from the driving device 11 is allowed to pass the through hole. The heat insulating member 19 provided around the chamber 6 is provided with an opening 19 *a* having a larger diameter than the opening of the chamber 6, near a center part of a bottom surface thereof, and the driving device 11 is installed through the opening 19 *a*.

In the rotor room 5, a rotor 2 for holding a sample to be separated is detachably mounted on a rotation shaft of the driving device 11. The rotor 2 is rotated at a high speed by the driving device 11 which is controlled by the control device 20. The driving device 11 is supported by the case body 23 via a plurality of damping rubbers 12 which are disposed in the case body 23. A plurality of buckets 3 are held by the rotor 2 so as to swing, and a plurality of tubes 4 which contain the sample are detachably loaded in the buckets 3. It is to be noted that in FIG. 1, a state where the rotor 2 is rotating at a high speed is shown. Therefore, the buckets 3 are shown in a state swung even to a horizontal direction (at a swing angle of about 90 degree) by a centrifugal force of the rotation. As the rotation speed of the rotor 2 is reduced, the swing angle of the buckets 3 becomes small, and in a state where the rotor 2 stays still, the swing angle of the buckets 3 becomes zero degree where the tubes 4 are in a vertical direction.

An operating panel 21 to which a user inputs conditions such as a rotation speed of the rotor 2, a separating time, and which also displays various information is disposed in an upper part of the door 7. The operating panel 21 is formed of a combination of a liquid crystal display device and operating buttons, or a touch type liquid crystal panel.

A drain hole 13 is formed in a part of the riser part 16 in a cylindrical shape which is formed in the bottom part of the chamber 6, and a drain pipe 14 is connected to the drain hole 13. Although the drain hole 13 is provided at only one position on an outer peripheral surface of the riser part 16 of the chamber 6, the dew condensation water remaining in the bottom part of the chamber 6 is effectively guided from the drain hole 13 to the drain pipe 14. This is because the dew condensation water is rotated in a circumferential direction, while being pushed inward in a radial direction, by the airflow which is generated along with the rotation of the rotor 2. The other end of the drain pipe 14 is extended downward in the vertical direction inside the case body 23, and one end of a flexible drain tube 15 is connected to the other end of the drain pipe 14. The other end of the drain tube 15 passes through a side part of a back surface or a lower surface of the case body 23 and is extended to the exterior. According to this structure, the dew condensation water remaining in the chamber 6 can be discharged to the exterior of the centrifugal separator 1.

Figure 2:
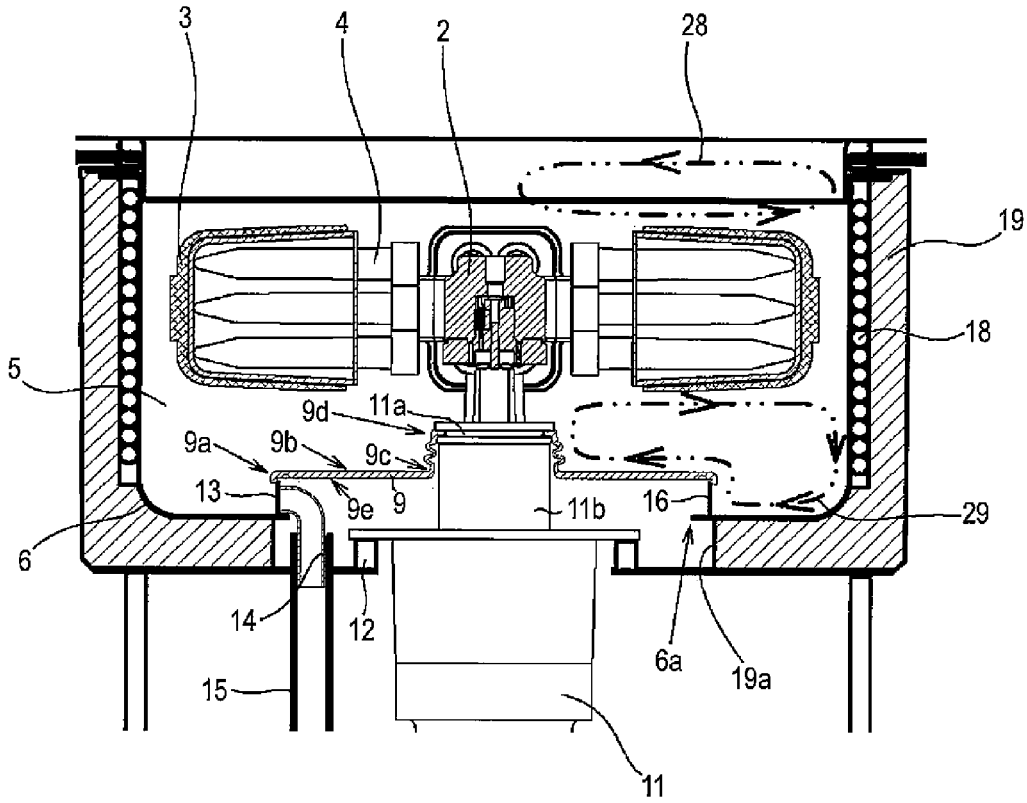
FIG. 2 is an enlarged sectional view of a part surrounding a rotor room 5 in FIG. 1.

FIG. 2 is an enlarged sectional view of a part surrounding the rotor room 5. The seal rubber 9 has a mounting part 9 *a* which is projected rather downward so as to be fitted over the opening of the riser part 16 at an upper end thereof. A through hole 9 *d* through which the upwardly extending rotation shaft of the driving device 11 is allowed to pass is formed in the seal rubber 9 at a position near its center axis. Because the through hole 9 *d* is engaged with an annular groove 11 a which is provided on an outer periphery of the rotation shaft, waterproofing performance of the driving device 11 is secured. The seal rubber 9 is provided with an accordion-shaped part having a predetermined height, at a lower side below the through hole 9 *d*. An upper surface part 9 *b* of the seal rubber 9 is defined from a lower end of the accordion-shaped part (a radially innermost part 9 *c*) to an outer circumferential side thereof. A region from the radially inner most part 9 *c* to the mounting part 9 *a* which is positioned at the radially outermost side is formed as a substantially flat surface region in an annular shape, and a region from the through hole 9 *d* to the radially innermost part 9 *c* functions as a connection part between the annular region and the rotation shaft of the driving device 11. In this embodiment, an undulated part, which will be described below, is formed in the substantially flat surface region in an annular shape.

Figure 3:
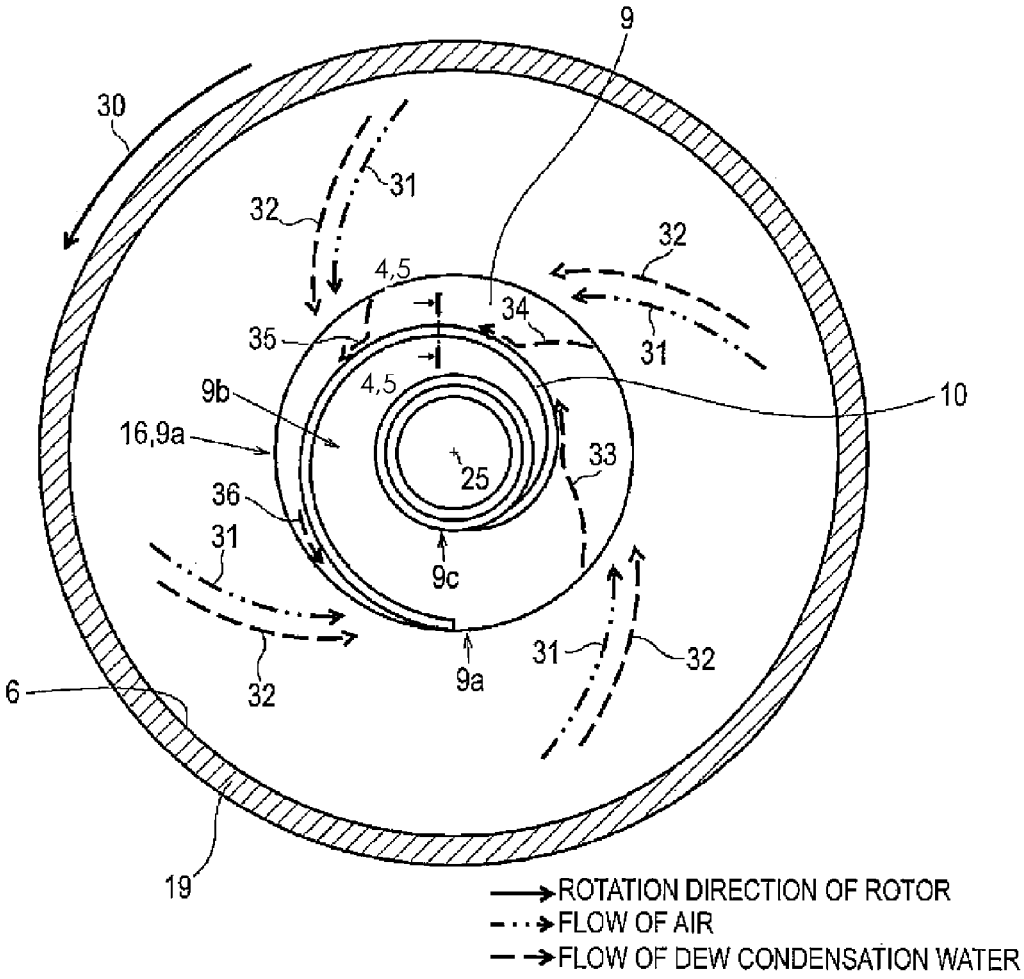
FIG. 3 is a sectional view taken along a line 3-3 in FIG. 1.

FIG. 3 is a sectional view as seen in a downward direction from a line 3-3 in FIG. 1. In the drawing, the rotor 2 rotates in a counterclockwise direction as shown by an arrow mark 30, when it is seen from the above. When the rotor 2 rotates, airflows in a manner of swirling, as seen in a side view, are generated above and below the rotor 2 in the rotor room 5, as shown by chain line arrow marks 28, 29 (See FIG. 2). In a region near the rotor 2 and the buckets 3, these airflows are such airflows as flowing from the radially inner side to the radially outer side due to a centrifugal force by the rotation of the rotor 2. The airflows which have arrived at an outer peripheral wall of the chamber 6 move along the outer peripheral wall (side surface) of the chamber 6 in a direction away from the rotor 2, that is, in an upward direction (the chain line arrow mark 28 in FIG. 1) and/or in a downward direction (the chain line arrow mark 29 in FIG. 1), to flow toward a rotation center of the rotor 2 through the regions separated from the rotor 2 and the buckets 3. In the bottom part of the chamber 6, the rotation direction of the rotor 2 and the direction of the swirling airflows as shown in FIG. 1 are combined, thereby to create airflows in a spiral shape directed to a rotation center 25, as shown by chain line arrow marks 31. The rotation center 25 is a point corresponding to the rotation center of the rotor 2 and the rotation axis of the driving device 11. The airflows flowing toward the rotation center of the rotor 2 do not flow from the radially outer side to the radially inner side perpendicularly to the circumferential direction, but flows in a manner of swirling by a rotation force of the rotor 2, specifically as shown by the chain line arrow marks 31. Accordingly, the dew condensation water which has adhered to the bottom surface of the chamber 6 also spirally flows to the radially inner side, as shown by broken line arrow marks 32 in FIG. 3. Although not shown in FIG. 3, the drain pipe 14 and the drain hole 13 are inclined in a direction of receiving these flows of the dew condensation water.

In the centrifugal separator 1 having the above described structure, when the rotor 2 is driven to rotate by the driving device 11 in the rotor room 5 of the chamber 6, the buckets 3 held by the rotor 2 are rotated by the centrifugal force keeping a horizontal posture, and the sample in the tubes 4 which are contained in the buckets 3 is centrifuged. On this occasion, the interior of the rotor room 5 is cooled by the cooling device, and the sample is cooled to a certain temperature via the rotor 2 which rotates in the rotor room 5. For the purpose of keeping the sample at a low temperature, for example, 4° C., it is necessary to cool the chamber 6 to almost 0° C. When the door 7 is opened after the centrifuging operation has finished, the atmosphere having a room temperature enters into the rotor room 5, and water contained in the atmosphere is condensed on an inner surface of the chamber 6 which has been cooled. As the results, the dew condensation water is generated and remains in the bottom part of the chamber 6.

When the rotor 2 is rotated for the next centrifuging operation, in a state where the dew condensation water remains on the bottom surface of the chamber 6, as described above, the spiral flows of the dew condensation water directed to the rotation center, as shown by the broken line arrow marks 32 in a plan view, are generated, and so, the dew condensation water is concentrated around the riser part 16 in a cylindrical shape which is formed in the bottom part of the chamber 6. Because the airflows in such directions as shown by the chain line arrow marks 31 are generated in the bottom part of the chamber 6, the dew condensation water which is concentrated around the riser part 16 flows along the rotation direction of the rotor 2 around the riser part 16 so as to stick to the riser part 16. Then, the dew condensation water flows from the drain hole 13 which is opened on the outer peripheral surface of the riser part 16 to the drain pipe 14, to be discharged from the drain tube 15 to the exterior of the centrifugal separator.

However, as shown by the chain line arrow mark 29 in FIG. 2, the airflows blowing upward to an upper part of the chamber 6 are generated around the cylindrical riser part 16 which is formed in the bottom part of the chamber 6. In case where the speed of the airflows is high or an amount of the dew condensation water is large, a part of the dew condensation water which has been pushed by the airflows overrides the riser part 16 to arrive at the upper surface part 9 *b* of the seal rubber 9, and spirally flows along the upper surface part 9 *b* of the seal rubber 9 toward the rotation center of the driving device 11. Because the dew condensation water on this occasion flows along the upper surface part 9 *b* of the seal rubber 9 toward the rotation center of the driving device 11, there is such anxiety that the dew condensation water may not arrive at the drain hole 13, as long as the rotor is rotated.

In view of the above, in this embodiment, as shown in FIG. 3, the seal rubber 9 covering the upper end opening of the riser part 16 is provided with an undulated part in a certain shape, for example, a projection 10 for guiding the flows of the dew condensation water, in its upper surface part 9 *b*. The projection 10 is provided in a spiral shape so as to be directed from the radially innermost part 9 *c* of the upper surface part 9 *b* of the seal rubber 9 toward an outer circumferential edge thereof. When the dew condensation water is pushed by the airflows to spirally flow along the upper surface of the seal rubber 9 toward the rotation center of the driving device 11, as shown by broken line arrow marks 33, 34, 35, the dew condensation water is blocked by the projection 10, before arriving at the radially innermost part 9 *c*. The dew condensation water which is blocked by the projection 10 is blocked by the projection 10 from flowing to the rotation center of the driving device 11, as shown by the broken line arrow marks 33, 34, 35, and flows along the projection 10 which spirally extends toward the outer circumferential edge of the seal rubber 9, with an aid of the airflows. After the dew condensation water has arrived at the outer circumferential edge of the seal rubber 9, it falls downward to a lower part of the riser part 16 with gravity. Then, the dew condensation water flows again around the riser part 16 to flow from drain hole 13 to the drain pipe 14, and is discharged to the exterior of the centrifugal separator.

Figure 4:
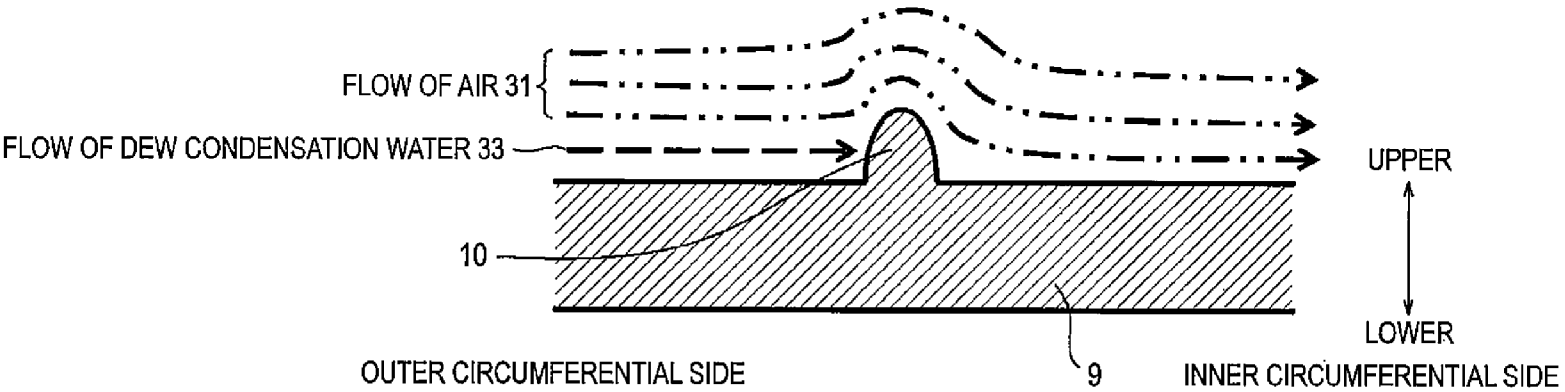
FIG. 4 is a sectional view taken along a line 4,5-4,5 in FIG. 3, and showing a shape of a projection in the embodiment according to the invention.

FIG. 4 is a sectional view taken along a line 4,5-4,5 in FIG. 3. The dew condensation water is blocked by the projection 10 from flowing to the rotation center of the driving device 11, as shown by the broken line arrow mark 33, and flows along the projection 10 which spirally extends toward the outer circumferential edge of the seal rubber 9, while only the airflows move overriding the projection 10, as shown by the chain line arrow marks 31. The projection 10 preferably has such a height that the dew condensation water may be blocked by the projection 10 at an angle nearly perpendicularly. In case where the projection 10 has a low height, the dew condensation water overrides the projection 10 with larger possibility. To the contrary, in case where the projection 10 is too high, a larger amount of the air is blocked by the projection 10, and a loss of the air is increased. As the results of experiments by the inventors, it was found that the height of the projection 10 is enough to be about 0.5 mm. Moreover, the projection 10 has preferably such a length in a lateral direction that the projection 10 is spirally wound around the seal rubber 9 by one or two windings. Because the projection 10 is formed in a spiral shape, arrangement of the projection 10 is not concentric with respect to the rotation center 25 in a plan view. Therefore, the dew condensation water can be effectively guided to the outer circumferential side. It is to be noted that the projection 10 in a spiral shape may have such a length as not attaining one winding around the seal rubber 9. Even with only three quarters of one winding, the advantage of the invention can be sufficiently obtained.

Figure 5:
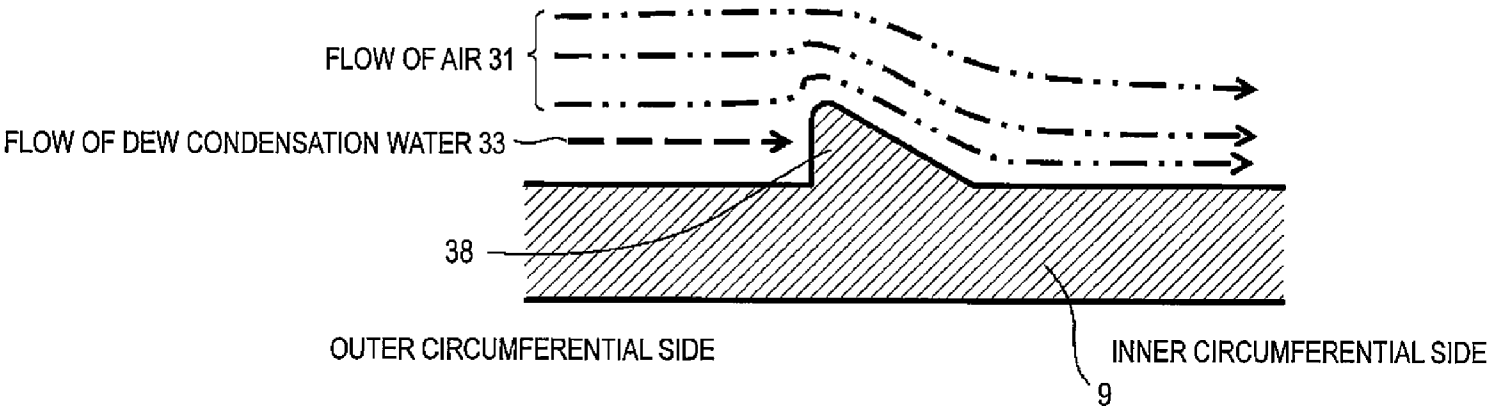
FIG. 5 is a sectional view corresponding to the sectional view taken along the line 4,5-4,5 in FIG. 3, and showing a shape of a projection in a modification of the embodiment according to the invention.

Moreover, a sectional shape of the projection 10 is not limited to the shape as shown in FIG. 4, but various modifications can be considered. For example, as shown in FIG. 5, a projection 38 having a substantially vertical surface at a side where the dew condensation water flows, and a surface at an obtuse angle at the opposite side may be formed. Although the dew condensation water is blocked by the substantially vertical surface and hardly overrides the projection 38, as shown by the broken line arrow mark 33 in FIG. 5, while the air smoothly flows because of the obtuse angle of the surface at the opposite side, as shown by the chain line arrow marks 31 in FIG. 5, and hence, an increase of the loss of the air can be depressed. In case where the projection 38 is too high, a larger amount of the air is blocked by the projection 10, and the loss of the air is increased. According to the experiments by the inventors, it was found that in case where an amount of the dew condensation water which arrives at the upper surface of the seal rubber 9 overriding the riser part 16 is not so large, the dew condensation water is unlikely to override the projection 38, even though the projection 38 is low, and the height of the projection 38 is enough to be about 0.5 mm. However, the height of the projection 38 need not be about 0.5 mm, but can be appropriately set depending on the amount and direction of the airflows which are generated in the rotor room, and the shape of the projection 38.

As described hereinabove, in the centrifugal separator 1 in this embodiment, it is possible to effectively guide the dew condensation water which overrides the riser part 16, or the dew condensation water generated on the upper surface of the seal rubber 9 covering the upper end opening of the riser part 16 to flow along the upper surface of the seal rubber 9, to a lower side of the riser part 16 by means of the projection 10 or 38. As the results, the dew condensation water can flow from the drain hole 13 which is provided on the outer peripheral surface of the riser part 16 to the drain pipe 14, and be discharged to the exterior of the centrifugal separator through the drain tube 15. Therefore, an anxiety of occurring such inconvenience that the sample may be mixed with the dew condensation water is eliminated.

In this embodiment, an element for guiding the dew condensation water is provided in a form of the undulated part such as the projection 10 or 38. However, the guiding means are not limited to the projection, but may be formed as a stepped part or as a separate member in a shape of a rail which is attached to the upper surface of the seal rubber 9. Further, the undulated part may be formed only as a groove. In case of the groove, a depth of the groove or an angle of the groove in a circumferential direction had better be adjusted so that the dew condensation water may flow in the groove up to the outer circumferential part, with the airflows.

Embodiment 2

Figure 6:
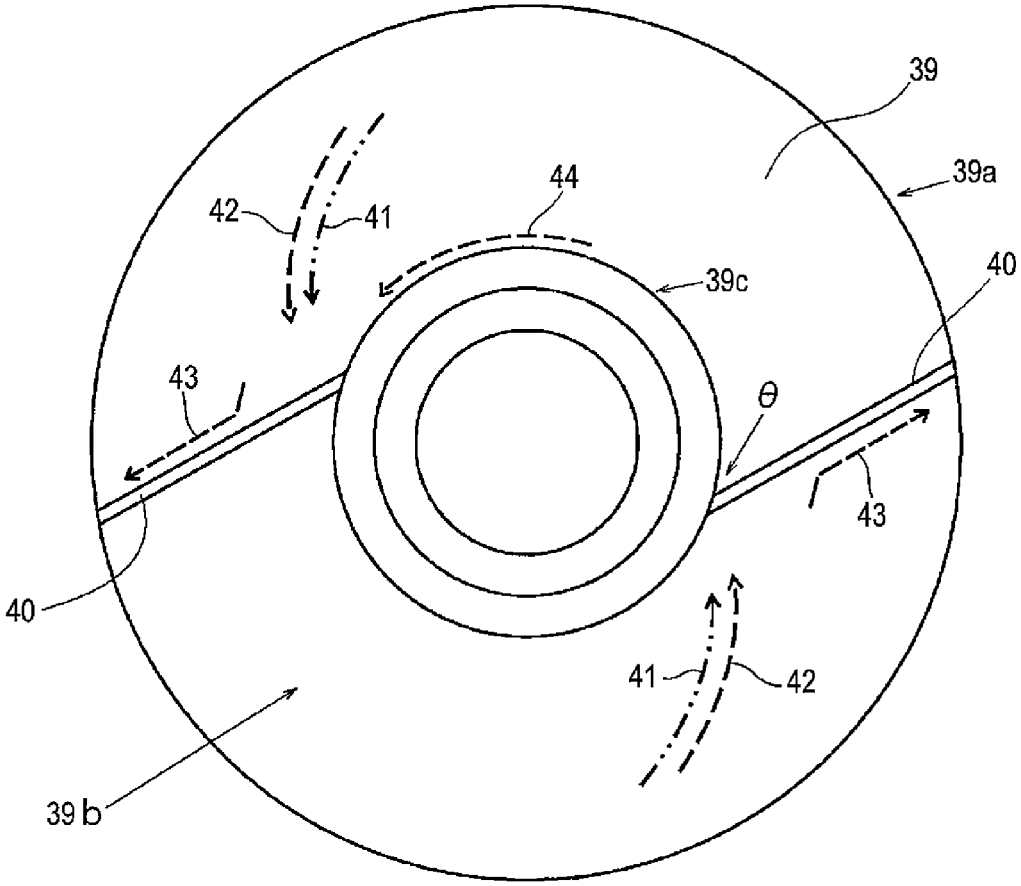
FIG. 6 is a plan view of a seal rubber 39 in a centrifugal separator in a second embodiment according to the invention.

Then, referring to FIG. 6, a shape of an upper surface of a seal rubber 39 according to a second embodiment will be described. In the second embodiment, two projections 40 are provided as the undulated part to be formed on an upper surface part 39 *b* of the seal rubber 39 which covers the upper end opening of the riser part 16. The projections 40 are provided linearly so as to be directed from the radially innermost part 39 *c* of the upper surface of the seal rubber 39 toward the outer circumferential edge 39 *a* thereof at a predetermined angle θ with respect to the circumferential direction. Herein, the predetermined angle is larger than 0 degree and smaller than 90 degree, and preferably, may be about 0 to 60 degree. The airflows as shown by chain line arrow marks 41 are generated by flows of the air which are generated by a centrifugal force following the rotation of the rotor 2, and accordingly, the dew condensation water spirally flows along the upper surface part 39 *b* of the seal rubber 39 toward the rotation center, as shown by broken line arrow marks 42. The dew condensation water which is blocked by the projections 40, before it arrives at the radially innermost part 39 *c*, is influenced by the airflows to flow along the projections 40 toward the outer circumferential side, as shown by chain line arrow marks 43. After the dew condensation water has arrived at the outer circumferential edge of the seal rubber 39, it falls downward to the lower part of the riser part 16 with gravity. Then, the dew condensation water flows again around the riser part 16 to flow from the drain hole 13 to the drain pipe 14, and is discharged to the exterior of the centrifugal separator through the drain tube 15.

On the other hand, the dew condensation water which has arrived at the radially innermost part 39 *c* before it is blocked by the projections 40 flows along the radially innermost part 39 *c*, as shown by a chain line arrow mark 44, under the influence of the airflow which flows in an axial direction while rotating. Then, the dew condensation water is blocked by the projections 40 and merged with the dew condensation water which flows, as shown by the chain line arrow marks 43, to flow to the outer circumferential side.

Although the seal rubber 39 in the second embodiment is provided with the two projections 40, the invention is not limited to the two projections, but one to several projections 40 may be provided. Moreover, although the angle θ is about 45 degree in the embodiment, this angle may be appropriately set depending on the direction and strength of the airflow which is generated by a centrifugal force following the rotation of the rotor 2. Further, although the projection 40 is formed in a rectilinear shape in this embodiment, the projection 40 may be formed in a smooth curve, or may be so set that the angle with respect to the circumferential direction may be changed, as it goes to the outer circumference.

Embodiment 3

Figure 7:
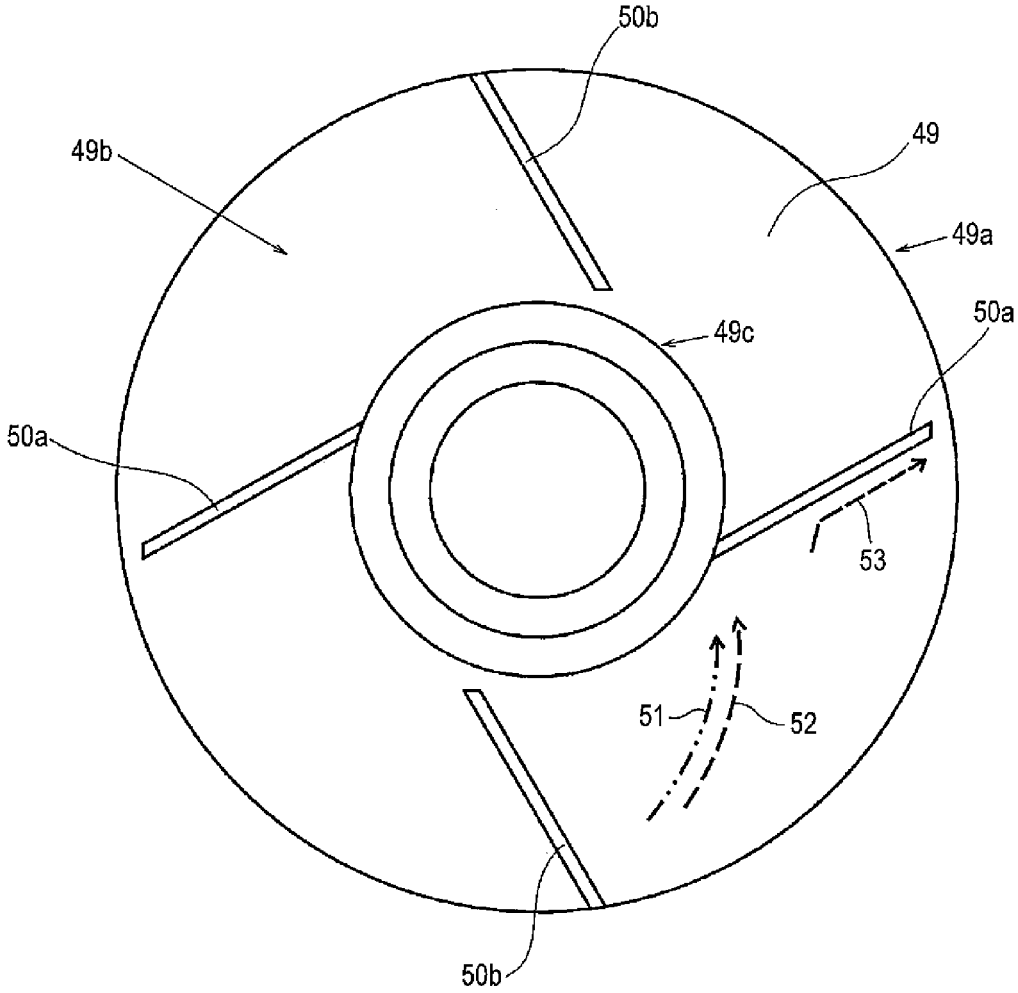
FIG. 7 is a plan view of a seal rubber 49 in a centrifugal separator in a third embodiment according to the invention.
Figure 8:
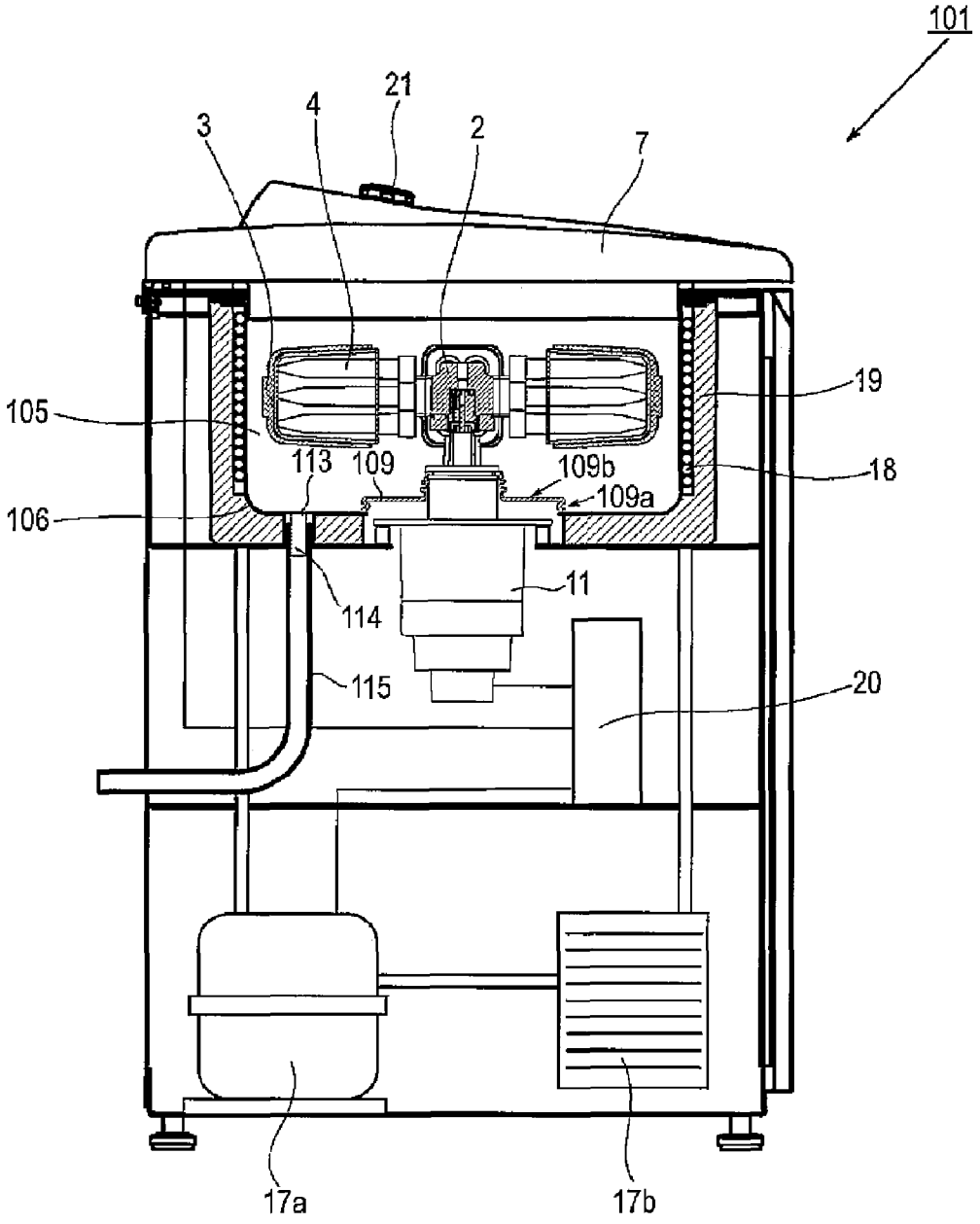
Fig. 8 Related Art
FIG. 8 is a sectional view showing an entire structure of a related centrifugal separator 101.

Then, referring to FIG. 7, a shape of an upper surface of a seal rubber 49 in a third embodiment according to the invention will be described. In the third embodiment, two types of projections 50 *a*, 50 *b* are provided as the undulated part to be formed on an upper surface part 49 *b* of the seal rubber 49 which covers the upper end opening of the riser part 16. The projections 50 *a*, 50 *b* are linearly provided so as to be directed from a radially innermost part 49 *c* of the upper surface of the seal rubber 49 toward an outer circumferential edge in directions perpendicular to the circumferential direction, and arranged in rotation symmetry so that they are overlapped at every 180 degree rotation. In this embodiment, the rotation symmetry is performed twice. The airflow as shown by a chain line arrow mark 51 is generated by a flow of the air which is generated by a centrifugal force following the rotation of the rotor 2, and accordingly, the dew condensation water spirally flows along the upper surface 49 *b* of the seal rubber 49 toward the rotation center, as shown by a broken line arrow mark 52. Then, the dew condensation water is blocked by the projections 50 *a*, 50 *b*, before it arrives at the radially innermost part 49 *c*. The dew condensation water which is blocked by the projections 50 *a*, 50 *b* is prevented from flowing toward the rotation center, by the projections 50 *a*, 50 *b*, and affected by a component force of the airflow as shown by the chain line arrow mark 51 to flow along the projections 50 *a*, 50 *b* toward the outer circumferential edge of the seal rubber 49. After the dew condensation water has arrived at the outer circumferential edge of the seal rubber 49, it falls downward to the lower part of the riser part 16 with gravity. Then, the dew condensation water flows again around the riser part 16 to flow from drain hole 13 to the drain pipe 14, and is discharged to the exterior of the centrifugal separator through the drain tube 15.

The seal rubber 49 in the third embodiment has such a shape that the projections 50 *a* are in contact with the radially innermost part 49 *c*, but not in contact with the radially outermost part 49 *a*. On the other hand, the projections 50 *b* are not in contact with the radially innermost part 49 *c*, but in contact with the radially outermost part 49 *a*. Because the two pairs of the projections 50 *a*, 50 *b* are made slightly different in shape from each other, the seal rubber 49 becomes flexible in fitting it to the riser part 16, and a fitting work can be easily performed. Moreover, because elasticity of the seal rubber 49 can be weakened to a certain extent, vibration resisting effect is enhanced, and durability can be improved. Because of simple structure and arrangement of the projections 50 *a*, 50 *b*, the seal rubber 49 in the third embodiment can be easily produced, and discharging efficiency of the dew condensation water can be remarkably improved, while the production cost is reduced to the least.

It is to be noted that in the third embodiment, the rotation symmetry of the projections 50 *a*, 50 *b* need not be twice symmetry, but may be n-times symmetry (wherein n>2). Moreover, the projections 50 *a* and 50 *b* may be formed in the same shape, specifically, may be so designed as to come into contact with both the radially innermost part 49 *c* and the radially outermost part 49 *a*.

Figure 9A:
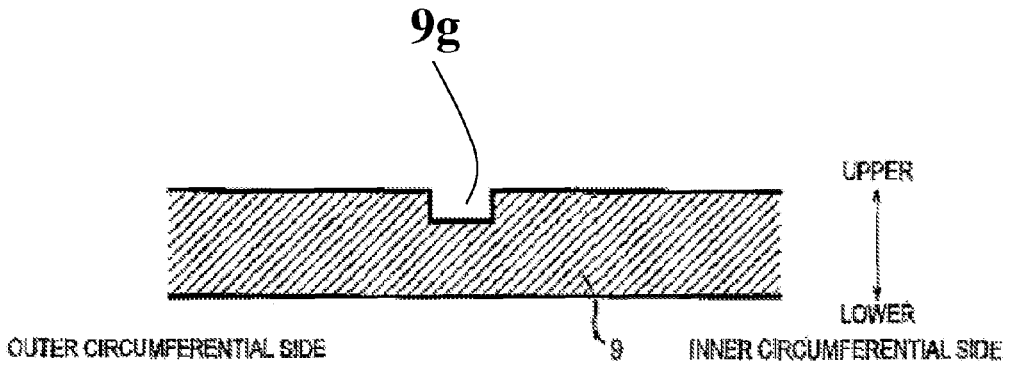
FIGS. 9A and 9B are schematic drawings showing a schematic representation of a groove and a stepped part, respectively.
Figure 9B:
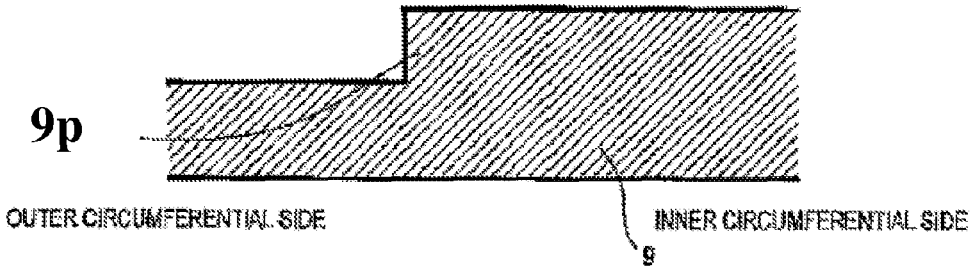

FIGS. 9A and 9B are schematic drawings showing a schematic representation of an exemplary groove 9*g* and exemplary stepped part 9*p*, respectively. In particular, FIG. 9A shows a schematic example of a groove 9*g* located in the seal rubber 9. Of course, because the drawing is schematic in nature, the drawing is only representative of the disclosure or existence of a groove 9*g* in the seal rubber 9. FIG. 9B shows a schematic example of a stepped part 9*p* located in the seal rubber 9. Likewise, the drawing is only representative of the disclosure or existence of a stepped part 9*p* in the seal rubber 9.

Although the invention has been heretofore described referring to the embodiments, the invention is not limited to the above described embodiments, but various modifications can be made within a scope not deviating from the gist of the invention. For example, although the rotor 2 of swing type has been described in the embodiments, the invention can be also applied in the same manner to an angle rotor in which a tube hole has a fixed angle. Moreover, although the seal rubber formed of rubber is used as the member for covering over the through hole in the chamber and the driving shaft, the seal rubber may be formed of other material than rubber, or may be formed of metal. Further, the undulated part provided on the upper surface of the seal rubber may be substituted with a number of small projections in a semispherical shape.

What is claimed is:

1. A centrifugal separator comprising:

a rotor configured to hold a sample to be separated;

a driving device configured to rotate the rotor and including a driving shaft;

a chamber configured to contain the rotor and including a through hole through which the driving shaft is passed;

a seal member configured to fitted over the through hole of the chamber and the driving shaft;

a cooling device configured to cool the chamber;

a door configured to seal an opening of the chamber;

a drain hole configured to discharge liquid in the chamber to an exterior; and an undulated part configured to guide a flow of the liquid toward an outer circumferential edge of the seal member, and which is provided on an upper surface of the seal member.

2. The centrifugal separator according to claim 1, wherein a riser part is disposed at the through hole of the chamber so as to be erected, the seal member is fitted to the riser part, the seal member includes a connection part to be connected to the driving device which is formed in a center part thereof, a fitting part to be fitted to the riser part at a circumferential side, and an annular region which is formed between the connection part and the fitting part, and the undulated part is provided on an upper surface of the annular region.

3. The centrifugal separator according to claim 2, wherein the drain hole is formed in the riser part.

4. The centrifugal separator according to claim 1, wherein the undulated part is formed so as to extend from the radially innermost part of the annular region to the outer circumferential side of the annular region.

5. The centrifugal separator according to claim 4, wherein the undulated part is continuously formed from the radially innermost part to the outer circumferential part.

6. The centrifugal separator according to claim 5, wherein the undulated part is formed so as to be in rotation symmetry with respect to a rotation center of the seal member.

7. The centrifugal separator according to claim 6, wherein the undulated part is one of a projection and a stepped part for blocking the flow of the dew condensation water.

8. The centrifugal separator according to claim 6, wherein the undulated part is a groove for guiding the dew condensation water.

9. The centrifugal separator according to claim 5, wherein the undulated part is spirally formed on an upper surface of the seal member.

10. The centrifugal separator according to claim 9, wherein the undulated part is one of a projection and a stepped part for blocking the flow of the dew condensation water.

11. The centrifugal separator according to claim 9, wherein the undulated part is a groove for guiding the dew condensation water.

12. The centrifugal separator according to claim 1, wherein the seal member is formed of rubber, and a lower surface of the seal member is formed flat.

13. A centrifugal separator comprising:

a rotor configured to hold a sample to be separated;

a driving device configured to rotate the rotor and including a driving shaft;

a chamber configured to contain the rotor and including a through hole through which the driving shaft is passed;

a seal member configured to fitted over the through hole of the chamber and the driving shaft;

a drain hole configured to discharge liquid in the chamber to an exterior; and an undulated part configured to guide a flow of the liquid toward an outer circumferential edge of the seal member, and which is provided on an upper surface of the seal member.

* * * * *